United States Patent [19]

Stillwell

[11] 4,125,141

[45] Nov. 14, 1978

[54] SELF DRAINING FRAME STRUCTURE

[75] Inventor: Nicholas Stillwell, White City, Oreg.

[73] Assignee: Stillwell Manufacturing Corp., Middlesex, N.J.

[21] Appl. No.: 824,657

[22] Filed: Aug. 15, 1977

[51] Int. Cl.[2] ..... E06B 3/32

[52] U.S. Cl. ..... 160/91; 49/408; 49/471; 160/44

[58] Field of Search ..... 160/90, 91, 44; 49/408, 49/471; 52/209

[56] References Cited

U.S. PATENT DOCUMENTS

| | | | |
|---|---|---|---|
| 1,188,155 | 6/1916 | Davis | 52/209 X |
| 2,918,706 | 12/1959 | Rust et al. | 49/408 |
| 3,091,008 | 5/1963 | Riegelman | 160/90 X |

*Primary Examiner*—Philip C. Kannan

*Attorney, Agent, or Firm*—Carella, Bain, Gilfillan & Rhodes

[57] ABSTRACT

A low cost drainage arrangement is described for closure frames which arrangement does not increase the overall size of the frames. Between the inner and exterior track recesses a passageway is provided to prevent the accumulation of water in the inner recess. The outer recess has at least one slot adjacent to the side of the frame and laterally displaced from the passageway. An exterior panel frame member for a screening panel or the like covers and shields the exterior portion of the passageway for free drainage during adverse weather conditions.

4 Claims, 3 Drawing Figures

SELF DRAINING FRAME STRUCTURE

BACKGROUND OF THE INVENTION

This invention generally relates to frame construction for portal openings including, e.g. doors and windows through exterior walls and, more particularly, to means in such frames to accommodate drainage of water during extreme weather conditions.

In doors and windows of exterior walls which have moveable panels or sashes to permit passage of air or for ingress and egress, rainfall, particularly when driven by heavy wind, will seep in and around the perimeter of the movable panels and collect within the frame. In the absence of continued rain accompanied by wind, the collected water can run out of one or more drain holes. However, a combination of the weather conditions which cause the water collection may prevent drainage, particularly where such weather conditions are persisting. More specifically, the wind pressure which drives rain water around the sash of a window is also capable of opposing the normal drainage from the window. In fact, the drainage arrangement itself may serve as an additional avenue for water to accumulate in the sill. such as accumulation of water, particularly if occurring at frequent intervals or for sustained periods, will damage the material of the frame.

One prior art arrangement designed to combat this problem utilizes a sill of special construction wherein a valve is utilized to close a drain hole in response to wind pressure. This arrangement is unsatisfactory for a number of reasons. Initially it is recognized that such construction adds to the cost of the window. Secondly the incorporation of the valve structure increases the size of the window. Thus, doors or windows having standard pane sizes will have non-standard, oversized frames. Therefore, not only is the material cost of the door or window increased, the cost of installation increases because the craftman must accommodate the non-standard frame sizes. Anyone remotely skilled in these arts recognizes the difficulties encountered in the building trades with non-standard components.

SUMMARY OF THE INVENTION

It is an object of this invention, therefore, to provide windows having improved drainage characteristics which may be manufactured with standard pane, frame and sash sizes.

Another object of the present invention is to provide improved window and door frame structures having improved drainage characteristics with only a minimal cost increase.

Yet a further object of the present invention is to provide an improved door and window construction wherein the drainage characteristics of the structure are not adversely changed by the occurrence of extreme weather conditions.

These objects and others not enumerated are achieved by window or door structure according to the present invention, one embodiment of which may include a closure frame with a self draining feature comprising a shielded passageway between the inner and outer recesses of the frame track members.

Among the more specific aspects of the illustrative embodiment of the present invention include an exterior panel frame member of sufficient width to shield the outer opening of a drain passage at all positions of the exterior panel frame.

BRIEF DESCRIPTION OF THE DRAWINGS

A more complete understanding of the present invention may be had from the following detailed description, particularly when read in the light of the accompanying drawings, wherein.

DETAILED DESCRIPTION

Figure 1:
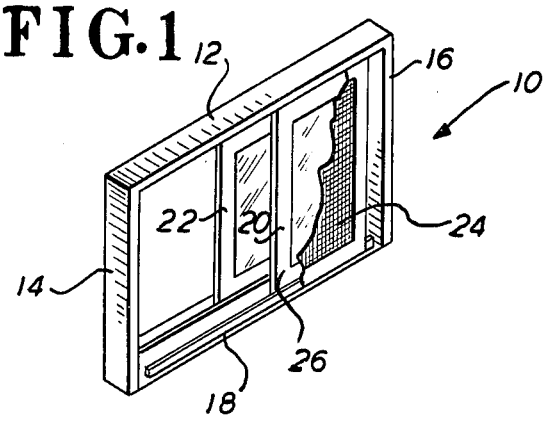
FIG. 1 is a perspective view of a closure structured in accordance with the teaching of the present invention.

Referring therefore to the drawings a closure structured according to the present invention is shown in perspective in FIG. 1 and designated generally by the reference numeral 10.

Although the invention is equally applicable to closures generally such as sliding doors or windows, the detailed description is made utilizing a screened sliding glass door structure as the illustrative embodiment.

Thus closure assembly 10 includes a frame having a top brace 12, opposed side braces 14, 16 and a base structure 18. The top brace 12, side braces 14 and 16 and base structure 18 cooperate to define a generally rectangular opening which is closed by a fixed door element 20, a sliding door element 22 and a sliding screen element 24. Each of door elements 20, 22 comprises a frame and glass pane mounted therein. Screen element 24 comprises a frame with screening mounted therein. As is discussed below in detail, the width of the frame of screen element 24 is in excess of one-half the width of the rectangular opening of assembly 10 such as to keep covered, at all times, the base of the actual post 26 of fixed door element 20.

Figure 3:
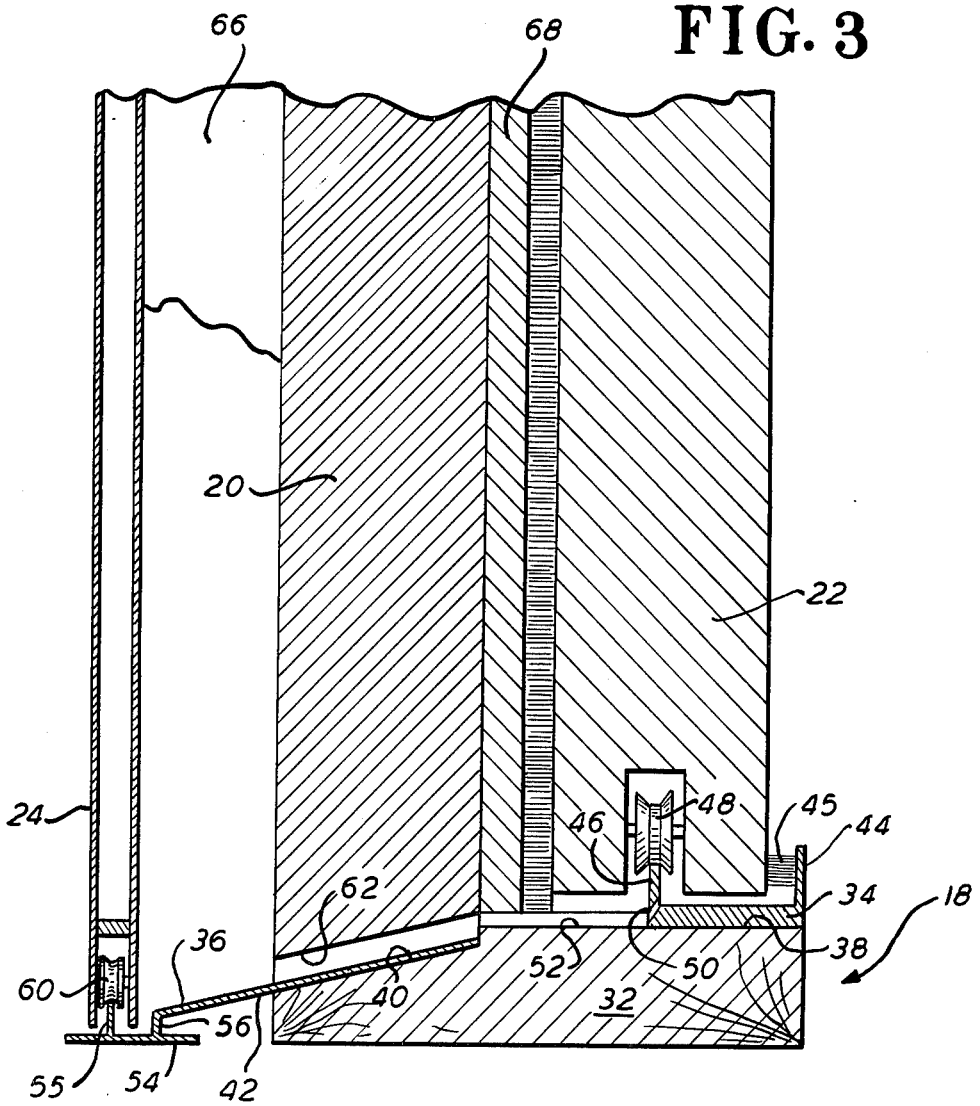
FIG. 3 is a cross-sectional elevational view through the plane 3—3 of FIG. 2.
Figure 2:
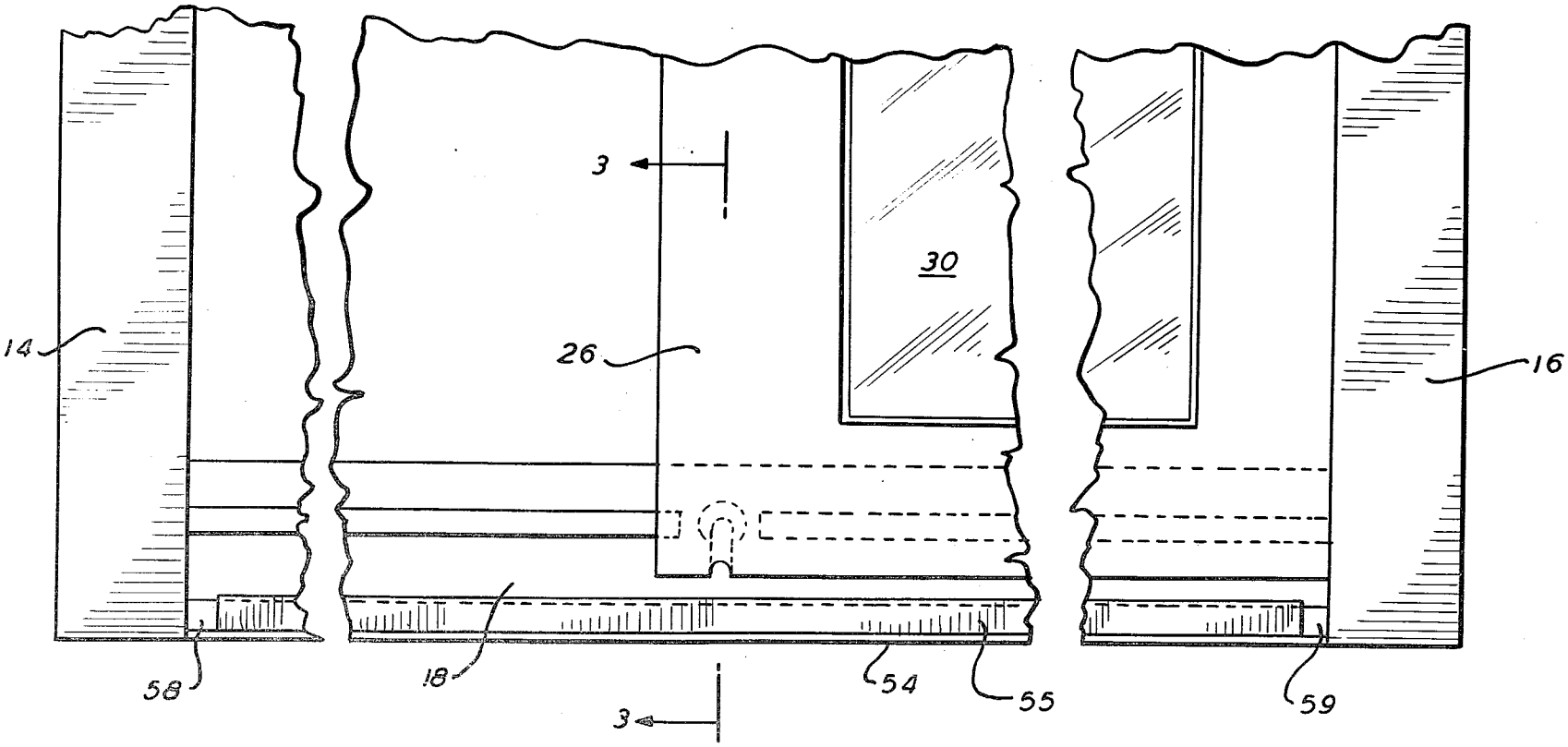
FIG. 2 is a partial front elevational view of the closure of FIG. 1.

Referring now particularly to FIG. 2, there is shown a partial front elevational view of the assembly 10 of FIG. 1. For purposes of illustration sliding door element 22 and sliding screen element 24 have been excluded from the view although each is shown in FIG. 3 which constitutes a cross-sectional elevational view through the plane 3—3 of FIG. 2. Fixed door element 20 includes a frame for enclosing a glass pane 30, the frame including a central post 26 which is a vertically extending member disposed substantially centrally between the side braces 14 and 16.

Base structure 18 and the operational relationship among the various elements of assembly 1 best may be seen with reference to both FIGS. 2 and 3. Referring to FIG. 3, initially, base structure 18 may be seen to comprise a pedestal 32 to which is securely attached an inner threshold or sill member 34 and an outer threshold or sill member 36.

Pedestal 32 is a rectangular wooden member which is relieved along its upper inner surface to define a channel 38 for receiving inner sill member 34. Pedestal 32 is also relieved along its upper outer surface to define a tapered channel 40 on which is securely fastened a tapered flange 42 of outer sill member 36.

Inner sill member 34 is a generally U-shaped member which is mounted in channel 38 and secured to pedestal 32 such as by screws. Inner sill member 34 extends the full length of base structure 18, i.e. for the full distance between side braces 14 and 16. The inner upwardly extending flange 44 of the inner sill member 34 defines a mounting structure for weather stripping 45 which may be of the brush type or any of the others generally known in these arts.

Outer upwardly extending flange 46 of inner sill member 34 defines a track on which is received rollers 48 (only one shown) which permit the sliding of door element 22 between open and closed positions. Formed in the lower corner of inner sill member is a throughbore 50. Throughbore 50 is disposed substantially centrally between side braces 14 and 16 and defines a fluid flow path between the channel defined by inner sill element 34 and a channel 52 formed in the upper surface of pedestal 32.

As is clear from the cross-section shown in FIG. 3, outer sill member 36 is a one-piece unit having a base 54, an outer upwardly extending flange 55 and an inner upwardly extending flange 56 from which extends tapered flange 42. With the exception of outer flange 55, outer sill member 36 is of a length to extend the full distance between side braces 14 and 16. Outer flange 55, however, is relieved at its ends, i.e. adjacent side braces 14 and 16 to provide openings 58 and 59 which define fluid flow passages for the exit of fluid from the channel defined by base 54 and upwardly extending flanges 55 and 56. Outer flange 55 also defines a track upon which are received the rollers 60 which accommodate the sliding movement of screen element 24.

Rigidly secured to the upper surface of tapered flange 42 is fixed door element 20. In this regard the lower edge of door element 20 is tapered such as to correspond to the taper of flange 42 thereby providing a surface-to-surface contact therebetween. Formed in the bottom surface of door element 20 at a point which is substantially centrally disposed between side braces 14 and 16 is a throughbore 62. Throughbore 62 is in alignment with channel 52 and bore 50 to cooperate therewith to define an escape path for any fluid which otherwise might be collected in the channel defined by inner sill 34. Thus, water from the channel of inner sill 34 passes therefrom through bore 50 into channel 52 in pedestal 32. Thereafter the fluid passes outwardly through bore 62, across the surface of tapered flange 42 and into the channel defined by outer sill member 36. Once in the channel of the outer sill member the fluid may flow toward either of the brace members 14 of 16 and thereafter out of the closure structure through openings 48 or 59.

As was discussed above briefly, sliding screen element 24 is of such width as to extend more than half the distance between side braces 14 and 16. Further, each end of sliding screen 24 is provided with a wiper seal 66 one of which is shown partially in FIG. 3), which may comprise a rubber strip or the like, which wiper seal establishes a weather seal in the gap between screen 24 and central post 26 of fixed door 20 whenever screen element 24 is in either the extreme right or the extreme left position as shown in FIG. 1.

Because of the width of screen element 24 and the weather seal established between the screen element and the fixed door 20, bore 62 in fixed door 20 is isolated from direct exposure to wind forces which in the past have interfered with drainage of such structures and which, often, have caused a reversal in the fluid flow. The structure of the present invention eliminates these problems by protecting the discharge opening of bore 62 and displacing the ultimate discharge openings to opposed ends of the structure.

It should be noted that a weather seal between fixed door 20 and sliding door 22 may be provided by the use of a channel mounted weather strip secured to the inner surface of post 26 of fixed door 20. Such weather stripping may be chosen from any of the various types known to those having skills in these arts.

It will be recognized by those skilled in these arts that many modifications and variations to the disclosed illustrative embodiment may be made without departing from the spirit and scope of the invention.

I claim:

1. A self draining closure structure comprising:

a frame having a top brace, opposed side braces and a base structure;

fixed closure element rigidly secured within said frame;

a slidable closure element mounted within said frame and supported by said base structure, said slidable element being slidable between a closed position adjacent one of said side braces and an opened position adjacent the other of said side braces;

a slidable screen element mounted within said frame and supported by said base structure, said slidable screen element being wider than the distance between said opposed side braces;

said base structure including an inner sill member, a pedestal and an outer sill member, said inner sill member including a bore formed therein, said pedestal including a channel formed therein, said bore and said channel being in communication and defining a fluid flow path;

a throughbore formed in said fixed closure element, said throughbore in said fixed closure element cooperating with said channel and said bore to define a fluid flow path for draining fluid tending to collect in said inner sill; and wherein said slidable screen element defines a barrier between the exterior of said closure and said fluid flow path.

2. A self draining closure structure according to claim 1 wherein said slidable screen element is sufficiently wide to define said barrier at all positions of closure of said screen element.

3. A self draining closure structure according to claim 1 wherein said outer sill member includes a track element upon which said slidable screen member is slidably mounted.

4. A self draining closure structure according to claim 3 wherein said track element extends less than the total distance between said side braces such as to define a fluid path for the passage of fluid out of said closure from said inner sill.

* * * * *